US008087442B2

(12) United States Patent
Ihara

(10) Patent No.: US 8,087,442 B2
(45) Date of Patent: Jan. 3, 2012

(54) ADHESIVE SHEET BONDING DEVICE

(75) Inventor: Atsumi Ihara, Osaka (JP)

(73) Assignee: AI & DI Co., Ltd., Osaka (JP)

( * ) Notice: Subject to any disclaimer, the term of this patent is extended or adjusted under 35 U.S.C. 154(b) by 239 days.

(21) Appl. No.: 12/441,065

(22) PCT Filed: Aug. 27, 2007

(86) PCT No.: PCT/JP2007/066520

§ 371 (c)(1),
(2), (4) Date: Nov. 6, 2009

(87) PCT Pub. No.: WO2008/032550

PCT Pub. Date: Mar. 20, 2008

(65) Prior Publication Data

US 2011/0132547 A1 Jun. 9, 2011

(30) Foreign Application Priority Data

Sep. 14, 2006 (JP) ..... 2006-249349

(51) Int. Cl.
*B65H 37/04* (2006.01)

(52) U.S. Cl. ..... 156/542; 156/540; 156/DIG. 2; 156/DIG. 45

(58) Field of Classification Search ..... 156/230, 156/238, 538, 539, 540, 541, 542, 556, DIG. 1, 156/2, 28, 33, 37, 39, 40, 45
See application file for complete search history.

(56) References Cited

U.S. PATENT DOCUMENTS

| | | | | |
|---|---|---|---|---|
| 3,428,509 | A * | 2/1969 | Messmer | 156/361 |
| 4,325,774 | A * | 4/1982 | Sato | 156/542 |
| 4,813,571 | A * | 3/1989 | Slagter | 221/13 |
| 5,370,754 | A * | 12/1994 | Soloman | 156/64 |
| 5,399,228 | A * | 3/1995 | Schroeder et al. | 156/542 |
| 5,549,783 | A * | 8/1996 | Schroeder et al. | 156/542 |
| 5,785,798 | A * | 7/1998 | Horsman et al. | 156/361 |
| 5,879,507 | A * | 3/1999 | Schroeder et al. | 156/542 |
| 6,273,170 | B1 * | 8/2001 | Finn et al. | 156/542 |
| 6,923,878 | B2 * | 8/2005 | Davis et al. | 156/64 |
| 2006/0249258 | A1 * | 11/2006 | Painter et al. | 156/541 |

FOREIGN PATENT DOCUMENTS

| | | |
|---|---|---|
| JP | 53-17040 | 12/1993 |
| JP | 11-171152 | 6/1999 |
| JP | 2001-278233 | 10/2001 |

OTHER PUBLICATIONS

International Search Report dated Mar. 26, 2009.

* cited by examiner

*Primary Examiner* — Khanh P Nguyen
*Assistant Examiner* — John Blades
(74) *Attorney, Agent, or Firm* — Young & Thompson

(57) ABSTRACT

A sheet attaching apparatus includes a non-adhesive guide sheet for leading the peeled sheet to the attaching position while keeping away from the substrate; a stopper to which forward edges of the substrate and the sheet contact, movable between a position across the feed path and a position off the feed path; a movable press roller for pressing the forward portion of the sheet onto the forward portion of the substrate to attach the sheet onto the substrate at the attaching position; and a feed roller arranged facing the press roller and for discharging the adhered sheet and substrate from the attaching position. The guide sheet has slits extending in the feed direction at the forward portion. The press roller presses the forward portion of the sheet to the forward portion of the substrate through the slits so as to attach the sheet S onto the substrate.

4 Claims, 12 Drawing Sheets

ADHESIVE SHEET BONDING DEVICE

FIELD OF THE INVENTION

The present invention relates to an apparatus for placing an adhesive sheet onto a card body, as a substrate, and then attaching them together, used for producing an ID card such as a student identification card and membership card, for example. More particularly, it relates to an apparatus for placing one of adhesive sheets, arranged on a carrier strip in rows, onto a card body precisely without displacement.

The present invention is not limited to the application for producing of an ID card. And, the "substrate" includes all kinds of component capable of using as a substrate onto which an adhesive sheet is adhered, such as a nameplate and signboard, in addition to an IC card and magnetic card. The "sheet" includes all kinds of component adhered onto an item, such as a sheet onto which photograph and character can be printed and a protective sheet for a card.

BACKGROUND OF THE INVENTION

Some of an ID card such as a student identification card and membership card comprise a card body made of resin, having built-in electronic components such as an IC chip in which the holders' identification information and the like are recorded, and a sheet, on which visible images and characters such as the holders' photograph and address will be printed later, adhered onto one surface of the card body. Alternatively, the information may be preliminarily printed on the card body. Such the sheets are arranged on a roll of carrier strip in rows at predetermined intervals.

Usually, an operation for attaching the sheet onto the card body is manually carried out by peeling the sheet off the carrier, placing the sheet onto the card body precisely and then attaching them together. Or, the placement of the sheet onto the card body is sometimes carried out using a position adjust tool. In view of precision of the placement of the sheet and card body and efficiency of mass production, it is preferable to use an apparatus capable of placing the sheet onto the card body precisely and attaching them together. In the attaching operation, since the sheet needs to be placed onto the card body while facing an adhesive surface of the sheet to the card body, the sheet sometimes adheres onto the card body before the precise placement of the both. Accordingly, the machine has to be equipped with means for preventing an adhesion of the sheet onto the card body before a precise placement of the both.

Apparatuses for peeling a label off a carrier paper onto which many of the labels are arranged, and then attaching the peeled label onto an item are disclosed in Patent literatures 1 and 2, for example. The apparatus disclosed in the literature 1 has a performance such that a label peeled off the carrier paper by a peeling machine is set so as to come in contact with a press roller while an item onto which the label is adhered is supported on an bedplate facing the press roller, and then the press roller is moved toward the bedplate to attach the label onto the item. The apparatus is provided with a limit switch and a timer and the like for timing control of the precise placement of the label and the item. The apparatus disclosed in the literature 2 has a performance such that a label peeled off the carrier paper is supported by a suction device and then the suction device is moved to attach the label onto an item. The apparatus is provided with a microprocessor for control of the precise placement of the label and the item.

However, in the former apparatus, the label is adhered onto a long tubular bag, and in the later apparatus, a one-time use camera. So, such the apparatuses are different from an apparatus for attaching the sheet (label) onto the card body of approximately the same size as the sheet after the sheet is placed onto the card body without displacement in the length direction and the width direction, as with an apparatus for producing an ID card.

Patent literature 1: Japanese Patent Publication S53-17040

Patent literature 2: Japanese Laid Open Patent Application 2001-278233

SUMMARY OF INVENTION

An object of the present invention is to provide an apparatus for precisely placing the sheet onto the card body and then attaching them together.

An apparatus for placing one of adhesive sheets of predetermined size, arranged on a carrier strip in rows, onto a substrate precisely and attaching them together comprises:

a substrate feed station for feeding the substrate to an attaching position along a feed path;

a carrier strip feed station for feeding the carrier strip;

a peeling station for peeling the sheet off from the carrier strip;

a non-adhesive guide sheet for leading the peeled sheet to the attaching position while keeping away from the substrate;

a stopper to which forward edges of the substrate and the sheet contact at the attaching position, movable between a position across the feed path and a position off the feed path;

a movable press roller for pressing the forward portion of the sheet onto the forward portion of the substrate to attach the sheet onto the substrate at the attaching position; and a feed roller arranged facing the press roller and for discharging the adhered sheet and substrate from the attaching position, wherein the guide sheet has slits extending in the feed direction at the forward portion and the press roller presses the forward portion of the sheet to the forward portion of the substrate through the slits so as to attach the sheet onto the substrate.

According to the sheet attaching apparatus of the present invention, use of the non-adhesive guide sheet makes it possible to feed the peeled sheet to the attaching position while keeping away from the substrate and to align the forward edges of the sheet and the substrate at the attaching position. Therefore, the adhesion of the sheet and the substrate before the precise placement of the both can be prevented whereby precise placement and attaching operation can be performed.

At the attaching position, the adhesive sheet, guide sheet and substrate are overlapped in the order. The adhesive sheet does not come in contact with the substrate because of the thickness of the guide sheet even the guide sheet has the slits. However, when the presser roller is advanced after the precise placement of the sheet onto the substrate, it presses the adhesive sheet to the substrate through the slits, resulting in contact of the sheet and the substrate and thus adhesion of the both. Then, the adhesive sheet and the substrate are pressed across the full width thereof and thus the adhesive sheet is adhered onto the substrate.

In the present invention, preferably, the stopper is retracted from the feed path after the adhesion of the sheet and the substrate, the feed roller is driven to discharge the adhered sheet and substrate through between the press roller and the feed roller, and after the adhered sheet and substrate are discharged from the attaching position completely, the press roller is retracted and also the stopper advance across the feed path.

According to the present invention, it makes possible to attach the sheet onto the substrate from the forward portions thereof and then to discharge the sheet and substrate from the attaching position in the feed direction after alignment of the forward edges of the sheet and the substrate.

In the present invention, the sheet attaching apparatus preferably further comprises:

a crank arm and a cam provided on a rotating shaft;

a connecting rod, coupled to the crank arm at one end and coupled to the stopper at the other end, for oscillating the stopper between a position off the feed path and a position across the feed path;

a movable plate movable upward and downward relative to a main casing and pressed down by a function of the cam, the press roller being mounted to the movable plate movably upward and downward;

a spring mounted to the axis of the press roller; and a projection protruding from the movable plate and pushing the spring downward.

According to this structure, on rotating of the rotating shaft, the crank mechanism oscillates the stopper between a position across the feed path and a position off the feed path, and also the operation of the cam moves the press roller between a position on a feed path and a position off the feed path. And, it makes possible to drive the stopper and the presser roller at the following timing:

the first stage in which the substrate is being kept at the attaching position (initial stage, the stopper is across the feed path but the press roller is retracted from the feed path)→ the second stage in which the sheet is fed to the attaching position (the stopper is across the feed path but the press roller is retracted from the feed path)→ the third stage in which the forward portion of the sheet is adhered onto the forward portion of the substrate (the stopper is across the feed path and the press roller is advanced on the feed path)→ the forth stage in which the sheet and substrate are discharged from the attaching position while adhered together (the stopper is retracted from the feed path but the press roller is advanced on the feed path)→ the initial stage.

In the present invention, the sheet attaching apparatus preferably further comprises:

a substrate supply station for storing the substrates and feeding one of the substrates to the substrate feeding station;

wherein two or more stations among the substrate supply station, the carrier strip feeding station and the peeling station are stored in the main casing, two or more components among of the substrate feed station, the guide sheet, the stopper, the press roller and the feed roller are stored in one unit (movable casing) and the movable casing is movable relative to the main casing in the direction perpendicular to the feed direction.

If the card body and the sheet, which are fed from respective supply mechanisms, are displaced each other in the left and right directions, the movable casing is moved in the direction perpendicular to the feed direction to align the both in the right and left directions.

EFFECT OF THE INVENTION

As mentioned above, according to the present invention, a sheet attaching apparatus for placing the sheet onto the card body precisely and attaching them together can be provided. Use of the apparatus can improve precision of the placement of the sheet and the card body and also efficiency for producing the card.

DETAILED DESCRIPTION OF EMBODIMENT OF THE INVENTION

Hereinafter, a preferred embodiment of the present invention will be described in detail with reference to the drawings.

In this embodiment, an apparatus for producing an ID card by attaching an adhesive sheet S onto a card body B of approximately the same size of the sheet will be described. The adhesive sheets S are arranged on a carrier strip M in rows and the carrier strip M is rolled into a roll with the adhesive sheet S inward. One of the sheets A is supplied from the roll. The sheet S may be either blank or printed with necessary information.

FIG. 1 is a front drawing showing a structure of a main portion (sheet attaching structure) of the sheet attaching apparatus according to the present invention.

FIG. 2 is a front drawing showing a whole structure of the sheet attaching apparatus of FIG. 1.

FIG. 3 is a sectional side drawing showing the structure (sheet attaching structure) of the sheet attaching apparatus of FIG. 1.

First, the whole structure of the sheet attaching apparatus 1 will be described roughly.

As shown in FIG. 2, the sheet attaching apparatus 1 mainly comprises a substrate (card body) supply station 10; an attaching station 20; a carrier strip feed station 60; and a fixing station 80. The substrate supply station 10, the attaching station 20 and the fixing station 80 are aligned from the right side to the left side of the figure in order. The card body B is fed over a feed path extending from the upstream substrate supply station 10 from the downstream fixing station 80. During the feeding, the card body B is kept on an attaching position P in the attaching station 20, at which the sheet S peeled off the carrier strip M is fed from the carrier strip feed station 60, arranged over the attaching station 20 (shown in the upper and center portion of the figure), and is adhered onto the card body B.

The substrate supply station 10, the fixing station 80 and the carrier strip feed station 60 are stored in a main casing 2 and the attaching station 20 is stored in a movable casing 3 separated from the main casing 2 (described later in detail).

The substrate supply station 10 is provided with a stock section 11 in which a large number of card bodies B are stacked and stored; a feed roller 13 for feeding the lowermost card body B in the stack to the attaching station 20; and the like.

Referring to FIG. 1 mainly, the attaching station 20 will be described.

The attaching station 20, stored in the movable casing 3 described above, is mainly provided with a substrate supply unit 21 for supplying the card body B to the attaching position;

a stopper 24 with which the forward edges of the card body B and the sheet S come in contact at the attaching position P, downstream of the substrate supply unit 21;

a guide sheet 23 for feeding the peeled sheet S to the attaching position;

an upper roller (press roller) 27 which presses the forward portion of the sheet S onto the forward portion of the card body B at the attaching position P; and a lower roller (feed roller) 28, facing the upper roller 27, for discharging the adhered sheet S and card body B from the attaching position.

The movable casing 3, as shown in FIG. 3, has right and left side plates 3*a* in the feed direction and a base plate 3*b* on which the side plates 3*a* stand. A distance between the side plates 3*a* is slightly wider than the shorter length of the card body B. Under the base plate 3*b*, sliders 4 extending in the direction perpendicular to the feed direction, are mounted. The sliders 4 are slidably engaged with linier guides 5 extending in a direction perpendicular to the feed direction, mounted on a base plate 2*a* of the main casing 2. Thus, the movable casing 3 is movable to the main casing 2 in the direction perpendicular to the feed direction.

As shown in FIG. 1, the substrate supply unit 21 comprises pairs of upper and lower rollers 22 which are arranged between the side plates 3*a* of the movable casing 3. In this embodiment, three pairs of upper and lower rollers 22 are arranged from the upstream (the right side of the figure) to the downstream (the left side of the figure). The card body B, supplied from the substrate supply station 10, is fed by the pairs of the rollers 22 to the attaching position P at which the forward edge of the card body B contacts the stopper 24 as guided by guide plates (not shown) standing at the left and right side of the pairs of the rollers 22.

The stopper 24 is arranged at the most downstream end of a space between the side plates 3*a* of the movable casing 3. The upstream side of the stopper 24 forms the attaching position P. The stopper 24 is rotatably supported to the side plate 3*a* at the proximal portion 24*a* by a pin 25 and designed so as to oscillate between a position across the feed path and a position off the feed path by an after-mentioned oscillating unit. The stopper 24 is biased to the position across the feed path by a spring 26 under a normal state.

On the upstream side of the stopper 24, the upper roller 27 and the lower roller 28, facing the upper roller 27, are arranged. The upper roller is designed to move upward and downward by an after-mentioned mechanism. The lower roller 28 is driven by a motor. As shown in FIG. 3, in this embodiment, two pairs of upper rollers 27 and lower rollers 28 are arranged in the width direction of the card body B.

Over the attaching position 2, the guide sheet 23 is mounted.

FIG. 4 are drawings showing a structure of the guide sheet, FIG. 4(A) is a plan drawing and FIG. 4(B) is a front drawing.

The guide sheet 23 is for guiding the adhesive sheet S to the attaching position as described later and, as shown in FIG. 4, has a substantially rectangular sheet piece 23*a* and a mounting plate 23*b* for mounting the sheet piece 23*a* to the side plate 3*a* of the movable casing 3. The sheet piece 23*b* has substantially the same width as the sheet S and the length slightly shorter than the sheet S. The sheet piece 23*a* is mounted to the side plate 3*a* with the mounting plate 23*b* so as to extend obliquely downward and contact the stopper 24 with the forward edge thereof. The forward portion of the sheet piece 23*a* may be folded upward so as to be floated. The sheet piece 23*a* is made of a material to which the adhesive surface of the sheet S is hardly adhered (for example silicon resin). The sheet piece 23*a* is formed with slits 23*c* extending backward from the forward edge. The slits 23*c* are positioned under the upper rollers 27.

The movable casing 3 is further provided with a mechanism for oscillating the stopper 24; a movable plate 50 having a mechanism for moving the upper rollers 27 upward and downward; and the like (described later in detail).

Referring to FIG. 2, the carrier strip feed station 60 will be described.

As mentioned above, the sheets S are arranged on the carrier strip M in rows at predetermined intervals and the carrier strip M is rolled into a roll 61 with the sheet S inward. One of the sheets S is supplied from the roll. The carrier strip feed station 60 is provided with a reel 62 on which the roll 61 is mounted and a take-up reel 63 on which the carrier strip M is wound. And, the carrier strip feed station 60 is further provided with a guide plate 65 protruding over the upstream side of the guide sheet 23. The guide plate 65 is fixed to the side plate of the main casing 2 so as to extend obliquely downward toward the stopper 24, as shown in FIG. 1 also. Ahead of the guide plate 65, a return roller 66 for returning the carrier strip M is mounted. As shown in FIG. 1, the guide plate 65, the return roller 66 and the guide sheet 23 are aligned in the direction toward the stopper 24 in order.

The carrier strip M, supplied from the roll 61, is passed over the guide plate 65 via the guide roller 68 and is held around the return roller 66. The return roller 66 folds back the carrier strip M at substantially 340°. At this time, the sheet S adhered on the carrier strip M is not folded back and thus peeled off the carrier strip M because of its rigidity, and is fed obliquely downward with the adhesive surface down. And then, the sheet S slides on the guide sheet 23 with the adhesive surface down and then the forward edge of the sheet S comes in contact with the stopper 24.

The carrier strip M, from which the sheet S is peeled off, is wound onto the take-up reel 63 via a guide roller 69 and a tension roller 70. The take-up reel 63 is driven so as to unreel the roll 61 from the reel 62.

The fixing station 80 is for attaching the sheet S onto the card body B securely. The fixing station 80 is, as shown in FIG. 2, provided with upper and lower feed rollers 81; upper and lower heat rollers 82; and the like. The heat roller is made of heat-resistant rubber. The upper heat roller is rotatably supported in a heat plate 83 which covers the outer surface of the upper heat roller other than the surface facing the feed path. On heating the heat plate 83, the produced heat is translated to the heat roller and to heat it up to a predetermined temperature.

In a case in which the fixing is carried out using another apparatus such as a printing apparatus, it is not necessary to provide the heat roller.

A method for attaching the sheet S onto the card body B will be described.

FIGS. 5 to 10 are drawings showing the method for adhering the sheet onto the card body. Each of figures (A) is a front drawing and each of figures (B) is a side drawing. Firstly, behaviors of the sheet and the card body will be described mainly. The driving mechanism of the stopper and the upper roller are described later.

As shown in FIG. 5, the card body B is fed until the forward edge of the card body b contacts the stopper 24, and then the card body B is held at the attaching position. At this time, the stopper 24 is oscillated to be across the feed path and the upper roller 27 is retracted from the feed path.

Then, as shown in FIG. 6, the sheet S, peeled off the carrier strip M, is fed over the guide sheet 23 until the forward edge of the sheet S contacts the stopper 24. Since the card body B keeps away from the adhesive surface of the sheet S by the guide sheet 23, the sheet S is not adhered onto the card body B. And, since the forward edges of the sheet S and the card body B contact the stopper 24, as shown in FIG. 6(B), the forward edges of the both can be aligned. If the sheet S is displaced to the card body B in the left and right directions, the movable casing 3 is moved in the direction perpendicular to the feed direction for a suitable distance to align the card body B with the sheet S.

Next, as shown in FIG. 7, the upper rollers 27 are moved downward on the feed path. Although the guide sheet 23 is formed with the slits 23*c*, the adhesive sheet S is not adhered onto the card body B because of the thickness of the guide sheet 23. However, when the upper rollers 27 are moved downward onto the slits 23*c*, the adhesive sheet S contacts the card body B, placed on the lower rollers 28, through the slits 23*c* of the guide sheet 23, resulting in adhesion of the adhesive sheet S and the card body B.

Then, as shown in FIG. 8, the stopper 24 is oscillated to be retracted from the feed path. And then, as shown in FIG. 9, when the lower rollers 28 are driven, the card body B and the sheet S are discharged from the attaching position through between the upper and lower rollers 27 and 28. After the card body B and the sheet S are away from the guide sheet 23, the sheet S is adhered onto the card body B at the fixing station 80 in the whole width direction whereby the whole surfaces of the card body B and the sheet S are adhered.

After the card body B and the sheet S are completely discharged from the attaching position, the stopper 24 is oscillated to be across the feed path and the upper roller 27 is moved upward to be retracted from the feed path.

Referring to FIG. 1, FIG. 3, FIG. 11 and FIG. 12, a mechanism for moving the stopper and the upper roller at the above timing will be described.

FIG. 11 is a perspective drawing showing a mechanism for oscillating the stopper.

FIG. 12 are perspective drawings showing a mechanism for moving the upper roller upward and downward, FIG. 12(A) shows the upper roller positioned at the upper position and FIG. 12(B) shows the upper roller positioned at the lower position.

As shown in FIG. 1 and FIG. 11, over the stopper 24, a rotating shaft 30 is supported between the side plates 3*a* of the movable casing 3. The rotating shaft 30 is for moving the stopper 24 and the upper roller 27. As shown in FIG. 11, a back end of the rotating shaft 30 protrudes from the side plate 3*a*, to which a gear 31 is fixed. The gear 31 is engaged with a reduction gear 33 fixed to an output axis 32*a* of a motor 32. Driving of the motor 32 rotates the rotating shaft 30 through the reduction gear 33 and the gear 31.

A forward end of the rotating shaft 30 protrudes from the side plate 3*a*, to which a roller 35 is fixed. The roller 35 is for oscillating the stopper 24. The roller 35 has a connecting rod 36 coupled thereto in such a manner that one end (upper end) of the connecting rod 36 is coupled to the end surface of the roller 35 near the circumference edge with a pin 37 (the end surface extending between the rotating shaft 30 and the pin 37 functions as a crank arm). Another end (lower end) of the connecting rod 36 is coupled to a work portion 24*b* of the stopper 24. The lower end of the connecting rod 36 is formed with a long hole 36*a* through which a pin 38, coupling the connecting rod 36 to the stopper 24, is movably inserted. According to the above described structure, rotating of the roller 35 moves the pin 37, connecting the upper end of the connecting rod 36 to the roller 35, along a circular rotating path. As the result, the stopper 24 is oscillated between a position off the feed path in which it is pushed down by the connecting rod 36 and a position across the feed path in which it is biased by the spring 26.

The rotating shaft 30 is further provided with two cams 41 fixed thereto between the side plates. The cam 41 has a large diameter portion 41*a* having a circular circumference and a small diameter portion 41*b* having a circumference in which the radius gradually gets small from the both ends of the large diameter portion 41*a* toward the center. The cams 41 are for moving the upper roller 27 upward and downward.

The upper roller 27 is mounted to a movable plate 50 as shown in FIG. 3 and FIG. 12. The movable plate 50 is supported movably upward and downward between the side plates 31 of the movable casing 3. As shown in FIG. 3, the movable plate 50 has a U-shaped cross section and is provided with side plates 50*a* from which pin 51 stands. Each of the pins 51 is inserted through a long hole formed at the side plate 3*a* of the movable casing 3 so that the movable plate 50 can be moved upward and downward along the long hole. The upward and downward moving of the movable plate 50 is carried out by the cams 41, causing the upward and downward moving of the upper roller 27. In the inactive condition, the movable plate 50 is biased upward by a spring 52 and thus the pins 51 contact the upper ends of the long holes formed at the side plate 3*a* of the movable casing 3.

As shown in FIG. 12, the lower portion of each side plates 50*a* of the movable plate 50 is formed with a lengthwise long hole 50*b* through which a rotating axis 53 of the upper roller 27 is inserted. The upper roller is movably supported to the rotating axis 53. The rotating axis 53 has further a plate spring 54 fixed thereto. With an upper surface of the plate spring 54, a projection 55 protruding from the movable plate 50 comes in contact. In a state in which the movable plate 50 is biased upward by the spring 52 (shown in FIG. 12(A)), the rotating axis 27 of the upper roller 27 contacts the lower end of the long hole 50*b* by its own weight and the plate spring 54 is free of load with the projection 55.

A shaft 57 is fixed between the upper portions of the side plates 50*a* of the movable plate 50. To the shaft 57, cam followers 58 are rotatively mounted to which the cams 41 rotating contact. During the cam follower 58 contacts the large diameter portion 41*a* of the cam 41, the movable plate 50 is pushed down against a spring force of the spring 52. When the cam follower contacts the small diameter portion 41*b* of the cam 41, the movable plate 50 is biased upward by the spring 52.

Referring to FIGS. 5 to 10 mainly, a series of behaviors of the stopper 24 and the upper roller will be described associated with the motion of the card body B and the sheet S.

At the initial state shown in FIG. 5, the cam follower 58 (not shown in FIG. 5) contacts the small diameter portion 41*b* of the cam 41, and thus the movable plate 50 is biased upward and the upper roller 27 is shifted to the upper position so as to be retracted from the feed path. The pin 37, coupling the upper end of the connecting rod 36 and the roller 35, is positioned at a position slightly lower than the uppermost point of the rotating path of the pin. And, the pin 38, coupling the stopper 24 to the connecting rod 36, is positioned at the substantially center of the long hole 36*a* of the connecting rod 36. So, the stopper 24 is not pushed down and advances across the feed path. Then, the card body B, fed by the substrate supply unit 21 through the upper and lower roller 27 and 28, is waiting at the attaching position at which the forward edge of the card body B contacts the stopper 24. The lower roller 28 is out of rotating.

When the roller 35 begins to rotate counterclockwise from the initial state shown in FIG. 5, as shown in FIG. 6, the upper roller 27 is kept at the retracted upper position and the stopper 24 is kept across the feed path. During the rotation of the roller 35, the peeled sheet S slides on the guide sheet 23 and is fed between through the upper and lower roller 27 and 28 to the attaching position at which the forward edge of the sheet S contacts the stopper 24.

When the roller 24 rotates counterclockwise from the initial state for 90°, as shown in FIG. 7, the large diameter portion 41*a* of the cam 41 begins to contact the cam follower 58. As the result, the cam follower 58 is pushed down to move the upper roller 27 downward with the movable plate 50. When the cam follower 58 begins to contact the large diameter portion 41*a* from the small diameter portion 41*b* of the cam 41, the upper roller 27 is gradually moved down with the movable plate 50 while keeping the state shown in FIG. 12(A) and then in contact with the guide sheet 23. This makes the adhesive face of the adhesive sheet S to contact the card body B through the slits 23*c* of the guide sheet 23, causing adhesion of the adhesive sheet S onto the card body B. When the cam follower 58 contacts the large diameter portion 41*a* of the cam 41 completely, since the upper roller 27 contacts the lower roller 28 via the guide sheet 23, the sheet S and the card body B, the rotating axis 53 of the upper roller 27 is not moved downward any more. However, the movable plate 50 is further pushed down so that the projection 55 begins to compress the plate spring 54. Thus, the rotating axis 53 of the upper roller 27 is pushed down thereby to push the upper roller 27 to the lower roller 28. This causes a firm adhesion of the forward portions of the sheet S and the card body B and also provides a force for feeding the adhered sheet S and card body B forward. As shown in FIG. 12(B), the rotating axis 53 of the upper roller 27 is relatively moved upward in the long hole 50*b*.

During this time, the roller 35 rotates with the rotating shaft 30 and the connecting rod 36 is under driving. This causes a relative movement of the pin 38 inserted in the long hole 36*b* formed at the lower end of the connecting rod 36; however, the pin 38 is not reached the upper end of the long hole 36*b* so that the stopper 24 is not moved (kept across the feed path).

When the roller 35 rotates from the initial position shown in FIG. 5 for 180°, as shown in FIG. 8, since the cam follower 58 still contacts the large diameter portion 41*a* of the cam 41, the upper roller 27 is kept being pushed down. On the other end, the pin 37, coupling the upper end of the connecting rod 36 and the roller 35, reaches the undermost point of the rotating path of the pin 37. Also, the pin 38, coupling to the stopper 24, contacts the upper end of the long hole 36*a* and then is pushed down to oscillate the stopper 24 counterclockwise around the pin 25. As the result, the stopper 24 is retracted from the feed path. And, after the stopper 24 is retracted from the feed path, the lower roller 28 begins to be rotated. Since the upper roller 27 is being pushed down as described above, the card body B and the sheet S are sandwiched between the upper and lower rollers 27 and 28 and then discharged from the attaching position while adhered together.

The driving timing of the lower roller 28 is controlled according to a sensor for detecting a position of the light shielding plate attached to the rotating shaft 30.

When the roller 35 rotates from the initial state shown in FIG. 5 for 225°, as shown in FIG. 9, the card body B and the sheet S are discharged from the attaching position while adhered together. During this time, since the cam follower 58 still contacts the larger diameter portion 41*a* of the cam 41, the upper roller 27 is kept at the lower position. And, the pin 37, connecting the connecting rod 36 and the roller 35, is reached at the undermost point of the rotating path of the pin 37 to oscillate the stopper 24 to the undermost position. And, after the card body B and the sheet S are completely discharged from the attaching position, the driving of the lower roller 28 is stopped.

When the roller 35 rotates from the initial position shown in FIG. 5 for 315°, as shown in FIG. 10, the cam follower 58 begins to contact the small diameter position 41*b* of the cam 41. So, the movable plate 50 is biased upward by the spring 52 and thus the upper roller 27 is shifted upward to be retracted from the attaching position. And, since the connecting rod 38 begins to be moved upward, the stopper 24 is biased by the spring 26 to be oscillated across the feed path. As the result, the stopper 24 and the upper roller 27 return the initial position. Then, next card body B is fed to the attaching position.

The sheet adhering apparatus 1 can produce about 12 ID cards per one minute, for example.

BRIEF DESCRIPTION OF THE DRAWINGS

FIG. 4 are drawings showing a structure of the guide sheet.

FIG. 5 are drawings showing the method for adhering the sheet onto the card body.

FIG. 6 are drawings showing the method for adhering the sheet onto the card body.

FIG. 7 are drawings showing the method for adhering the sheet onto the card body.

FIG. 8 are drawings showing the method for adhering the sheet onto the card body.

FIG. 9 are drawings showing the method for adhering the sheet onto the card body.

FIG. 10 are drawings showing the method for adhering the sheet onto the card body.

FIG. 11 is a perspective drawing showing a mechanism for oscillating the stopper and FIG. 12 are perspective drawings showing a mechanism for moving the upper roller upward and downward.

EXPLANATION OF ITEM NUMBERS

Figure 1:
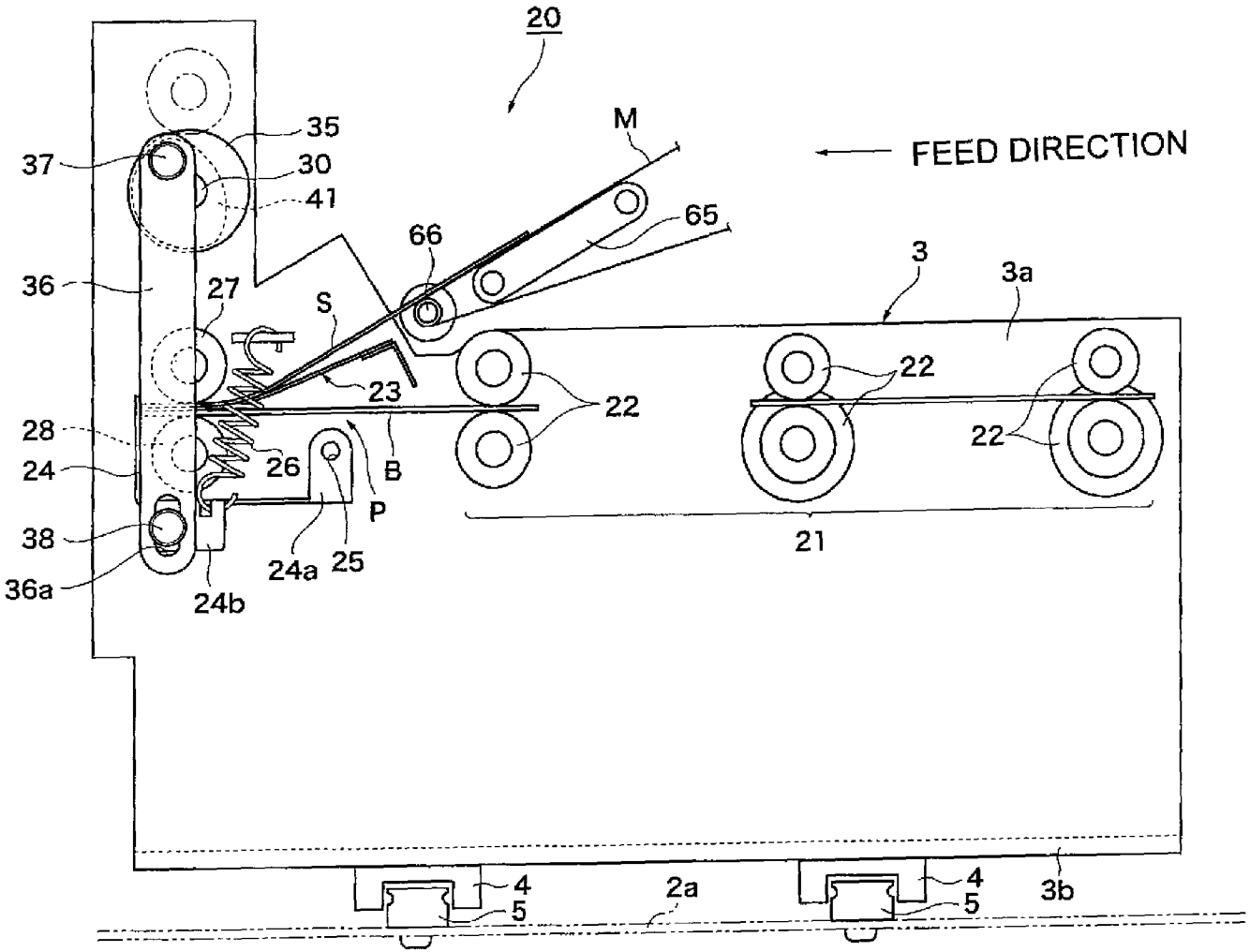
FIG. 1 is a front drawing showing a structure of a main portion (sheet attaching structure) of the sheet attaching apparatus according to the present invention.
Figure 2:
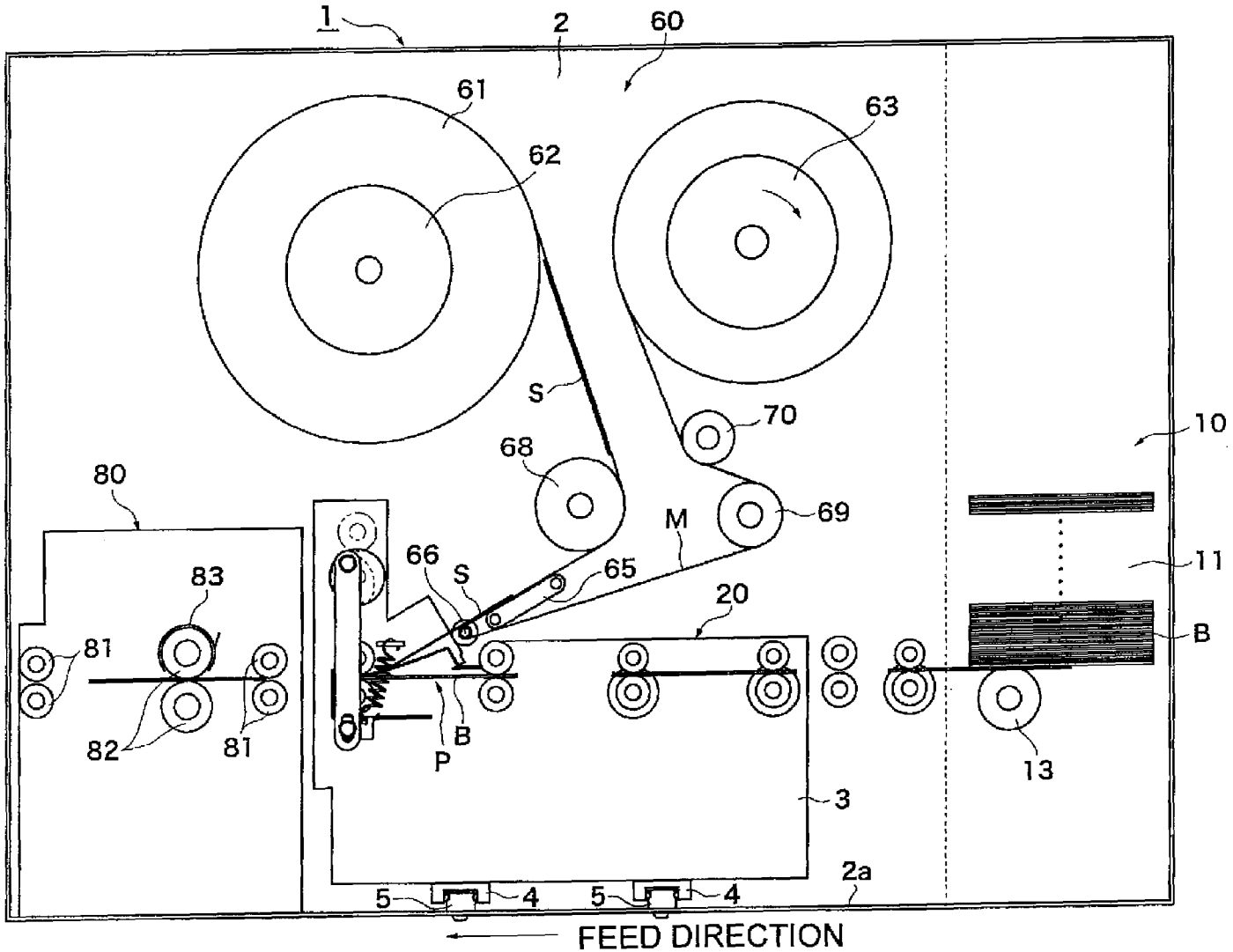
FIG. 2 is a front drawing showing a whole structure of the sheet attaching apparatus of FIG. 1.
Figure 3:
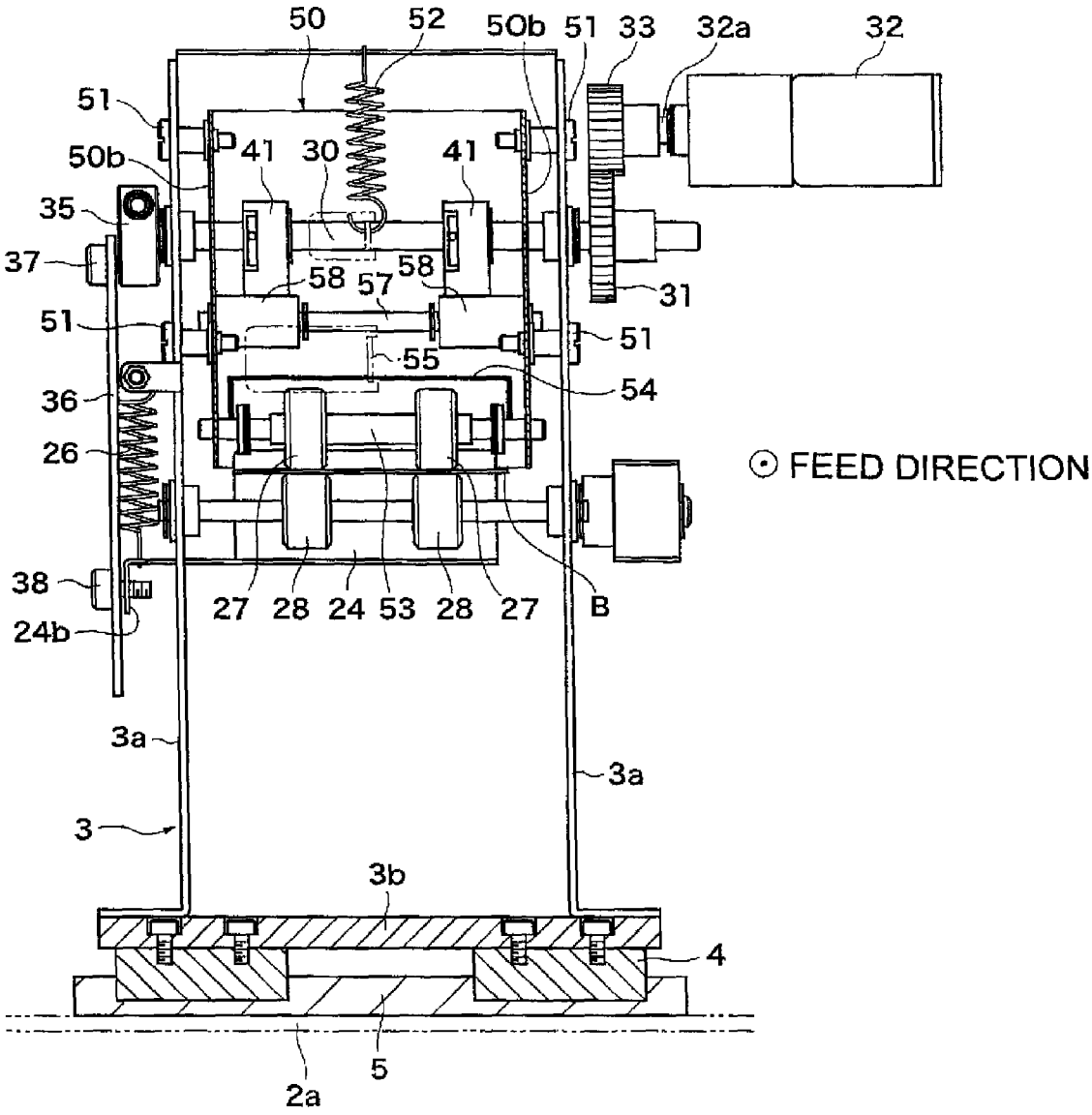
FIG. 3 is a sectional side drawing showing the structure (sheet attaching structure) of the sheet attaching apparatus of FIG. 1.
Figure 4A:
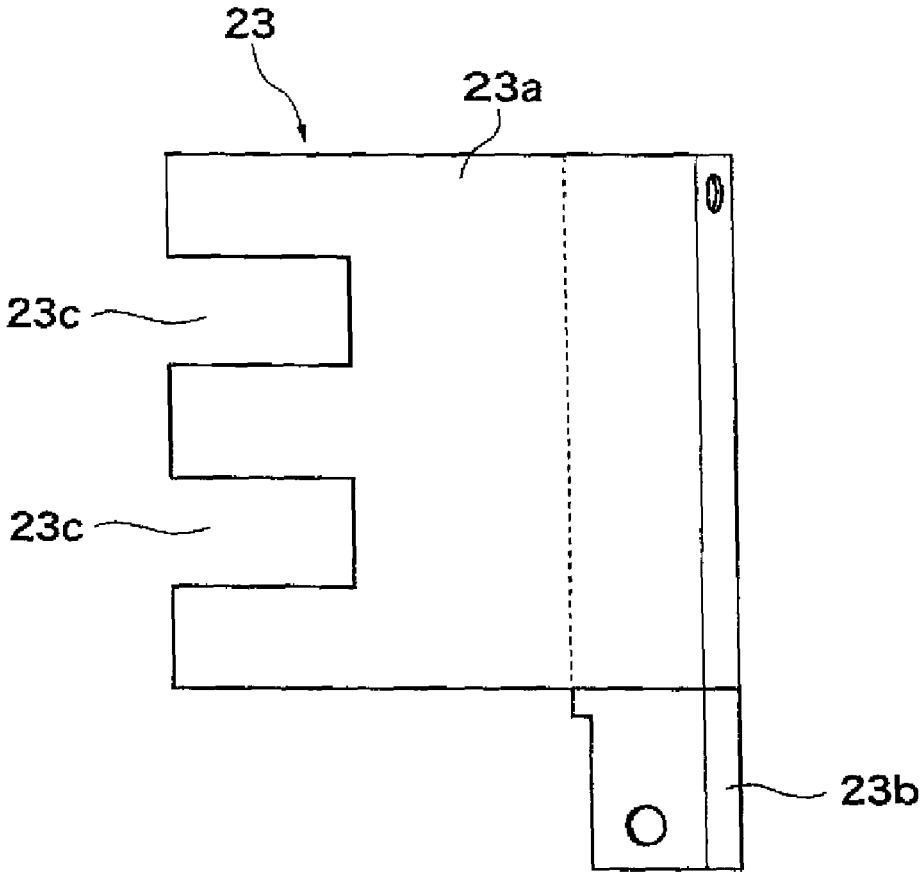
FIG. 4(A) is a plan drawing and FIG. 4(B) is a front drawing.
Figure 4B:
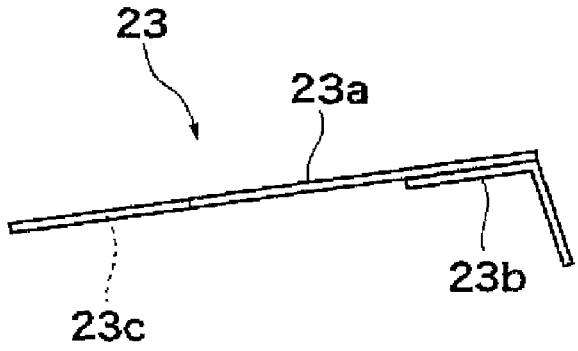
Figure 5A:
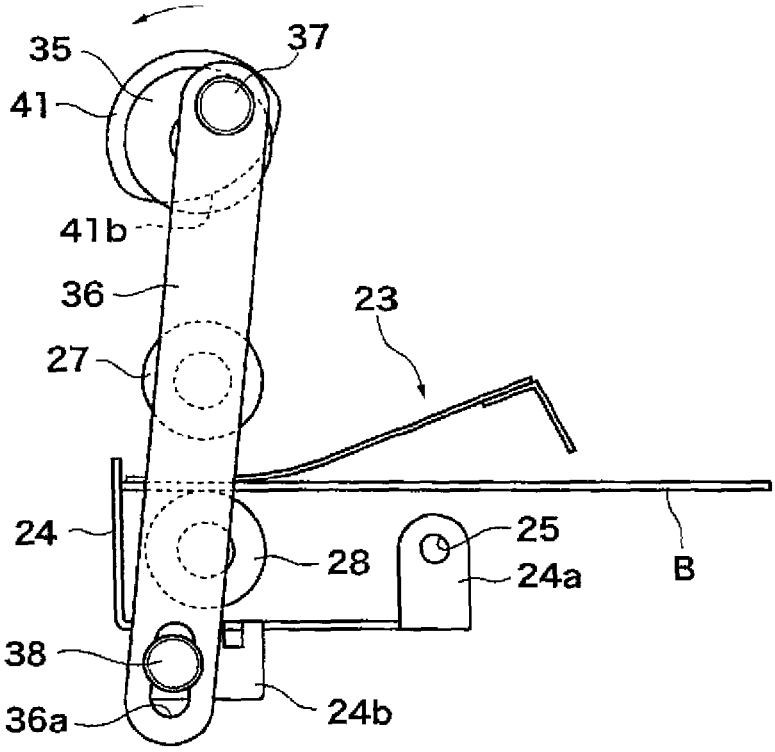
FIG. 5(A) is a front drawing and FIG. 5(B) is a side drawing.
Figure 5B:
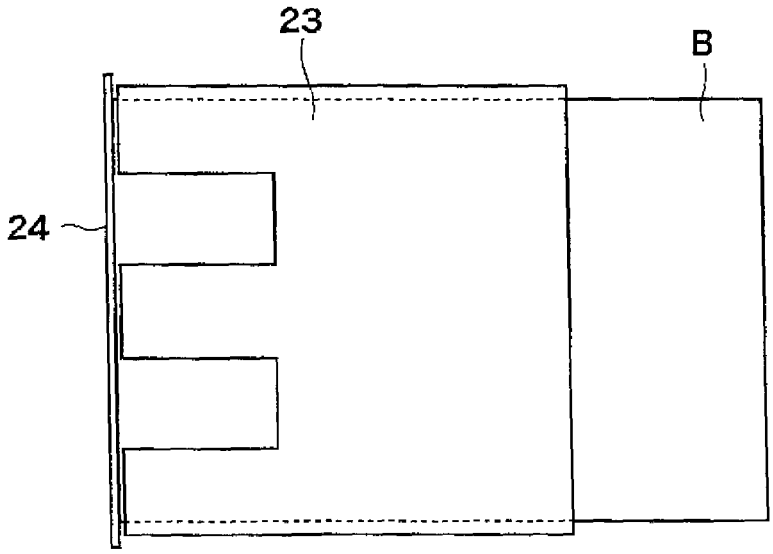
Figure 6A:
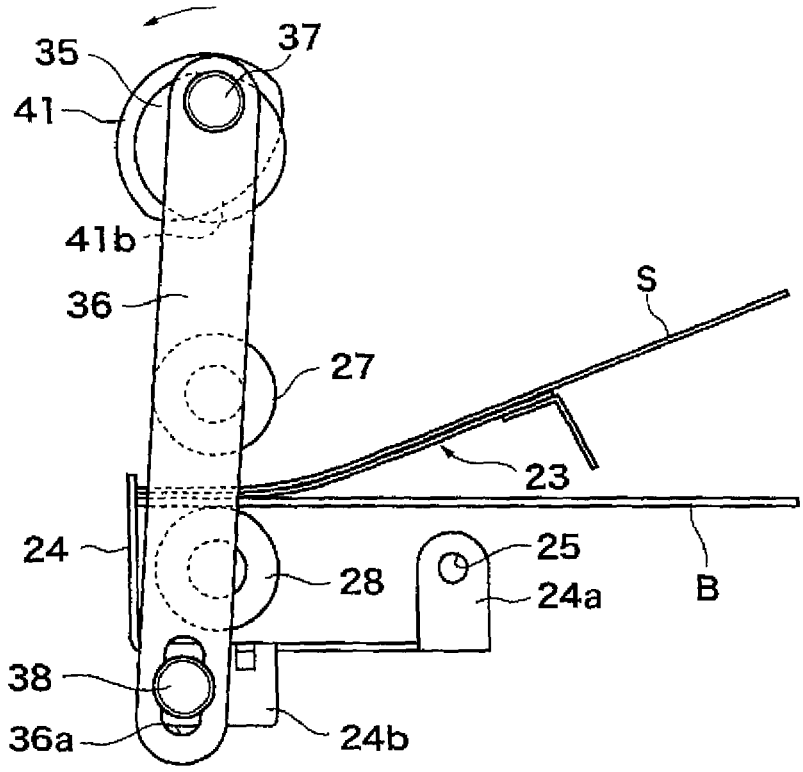
FIG. 6(A) is a front drawing and FIG. 6(B) is a side drawing.
Figure 6B:
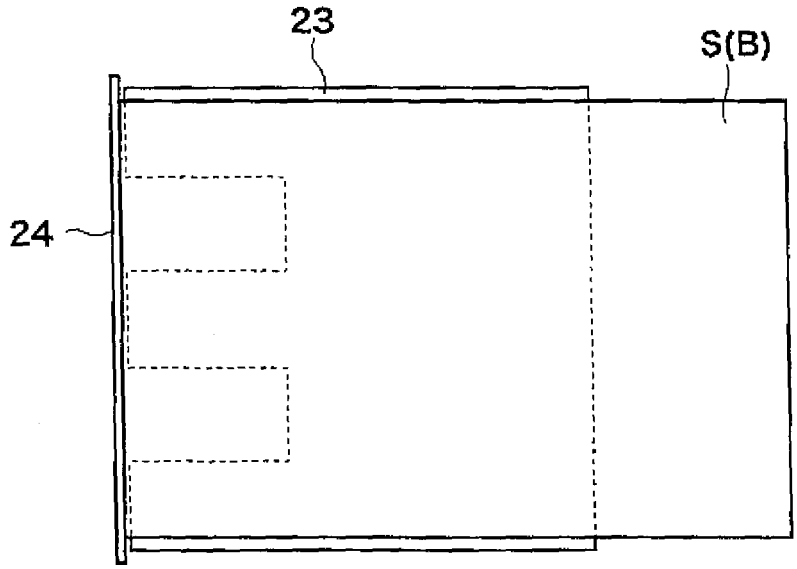
Figure 7A:
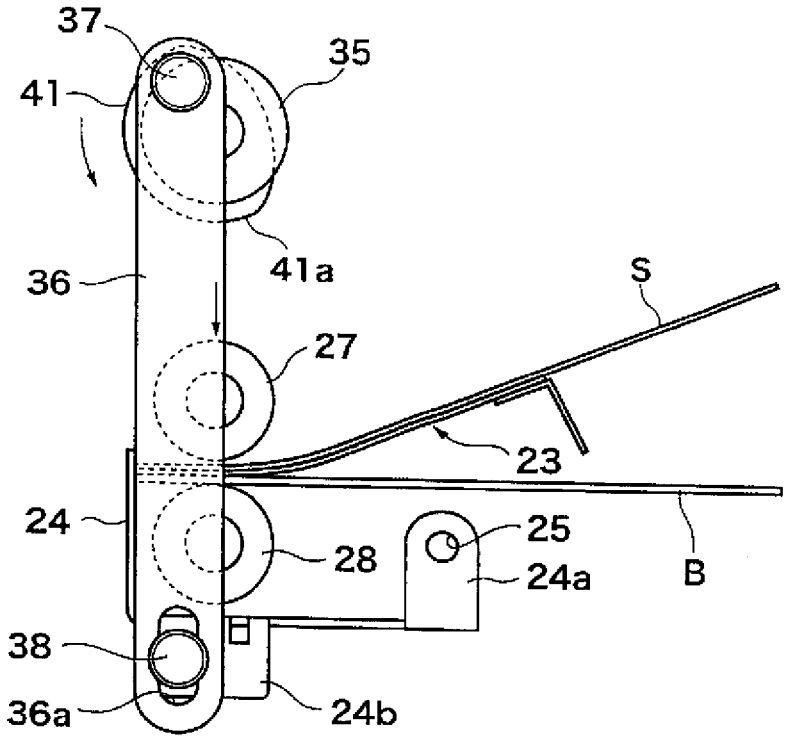
FIG. 7(A) is a front drawing and FIG. 7(B) is a side drawing.
Figure 7B:
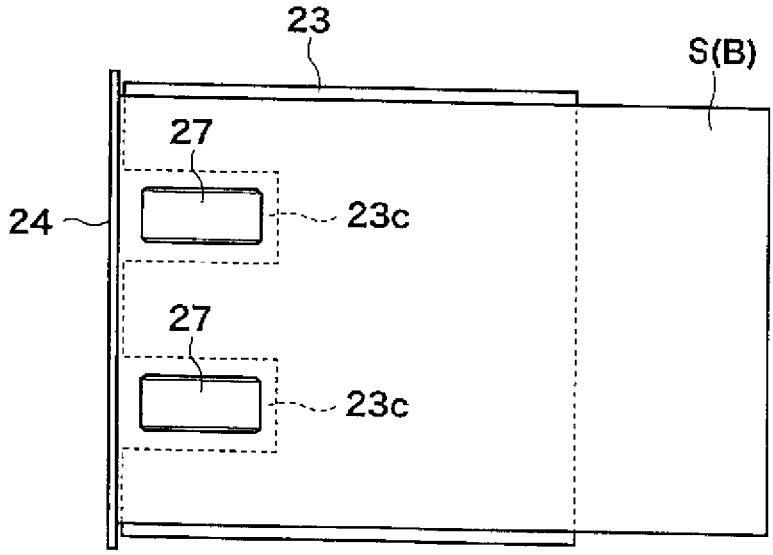
Figure 8A:
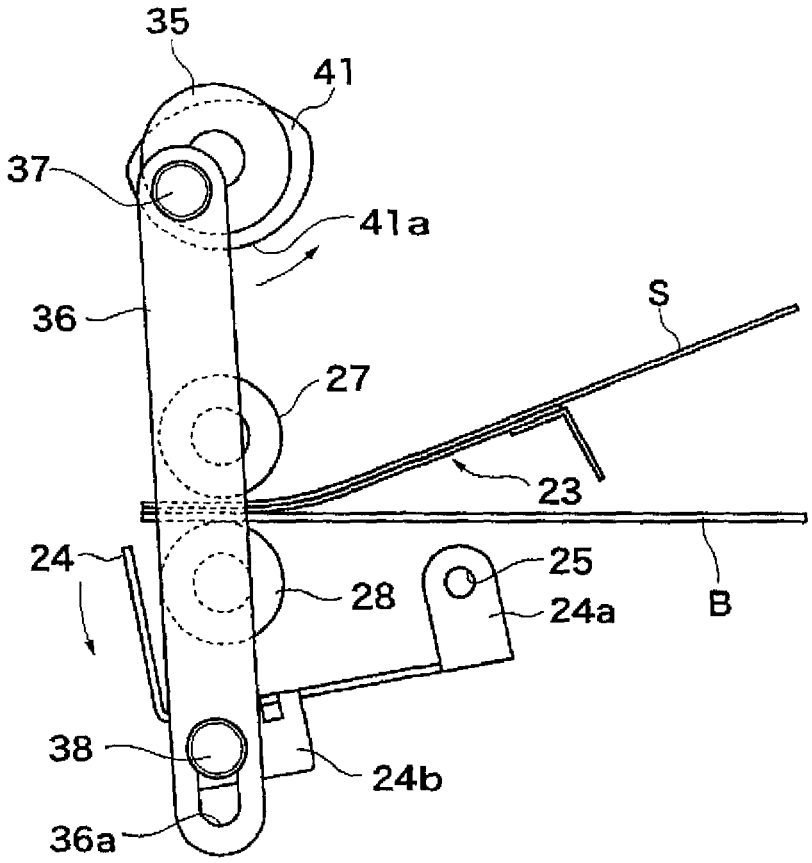
FIG. 8(A) is a front drawing and FIG. 8(B) is a side drawing.
Figure 8B:
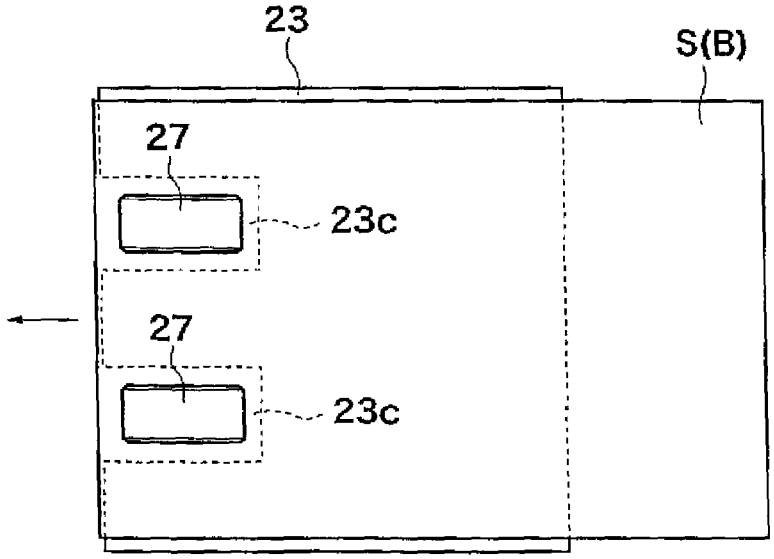
Figure 9A:
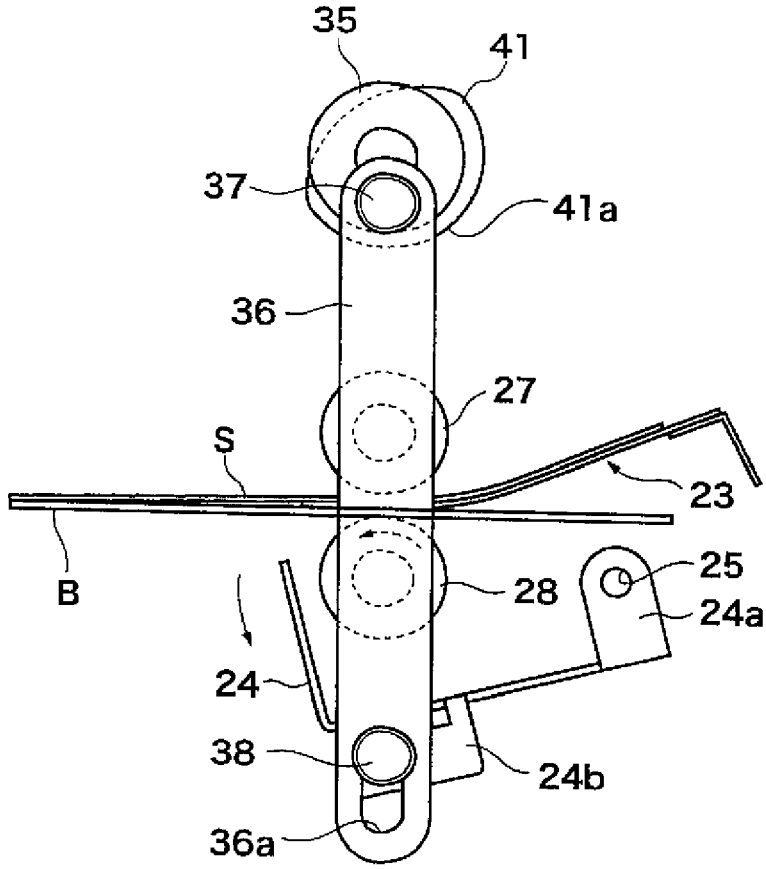
FIG. 9(A) is a front drawing and FIG. 9(B) is a side drawing.
Figure 9B:
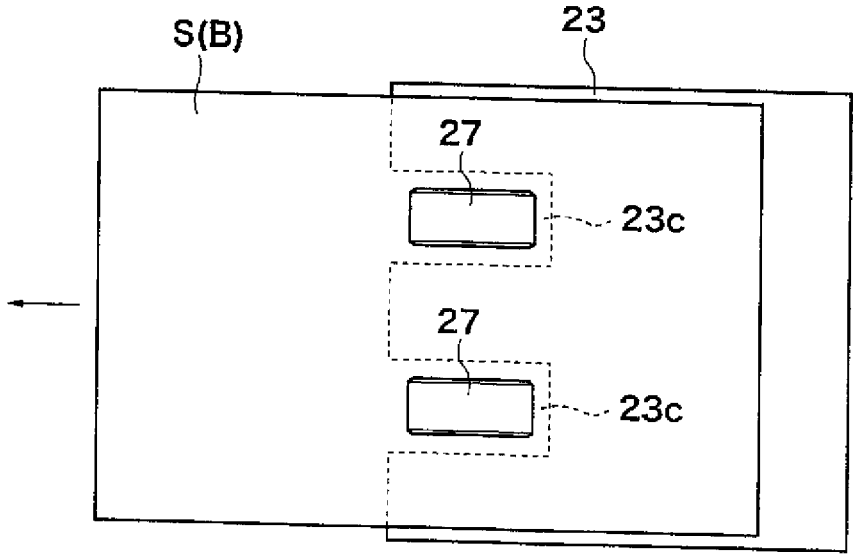
Figure 10A:
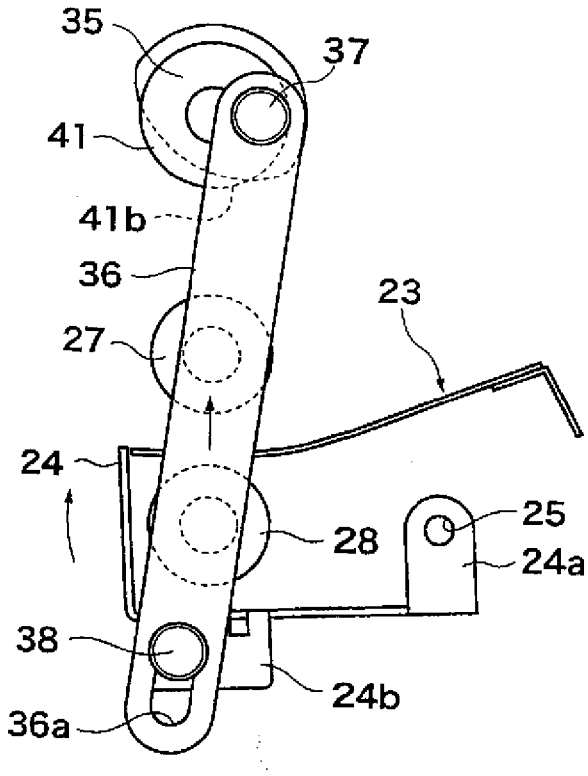
FIG. 10(A) is a front drawing and FIG. 10(B) is a side drawing.
Figure 10B:
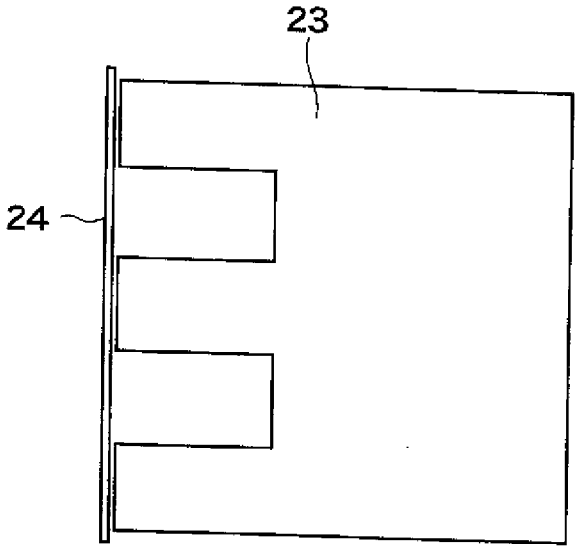
Figure 11:
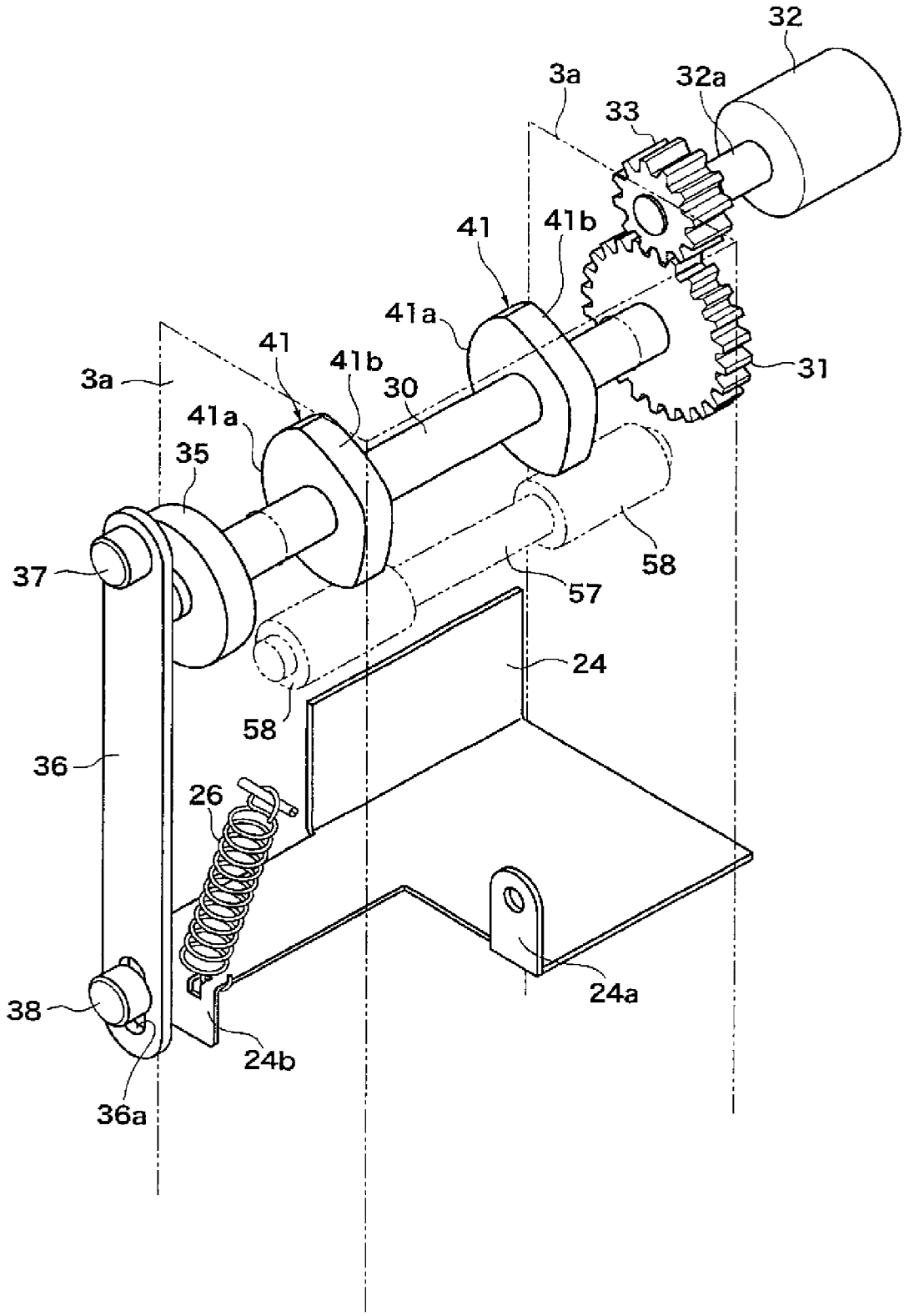
Figure 12B:
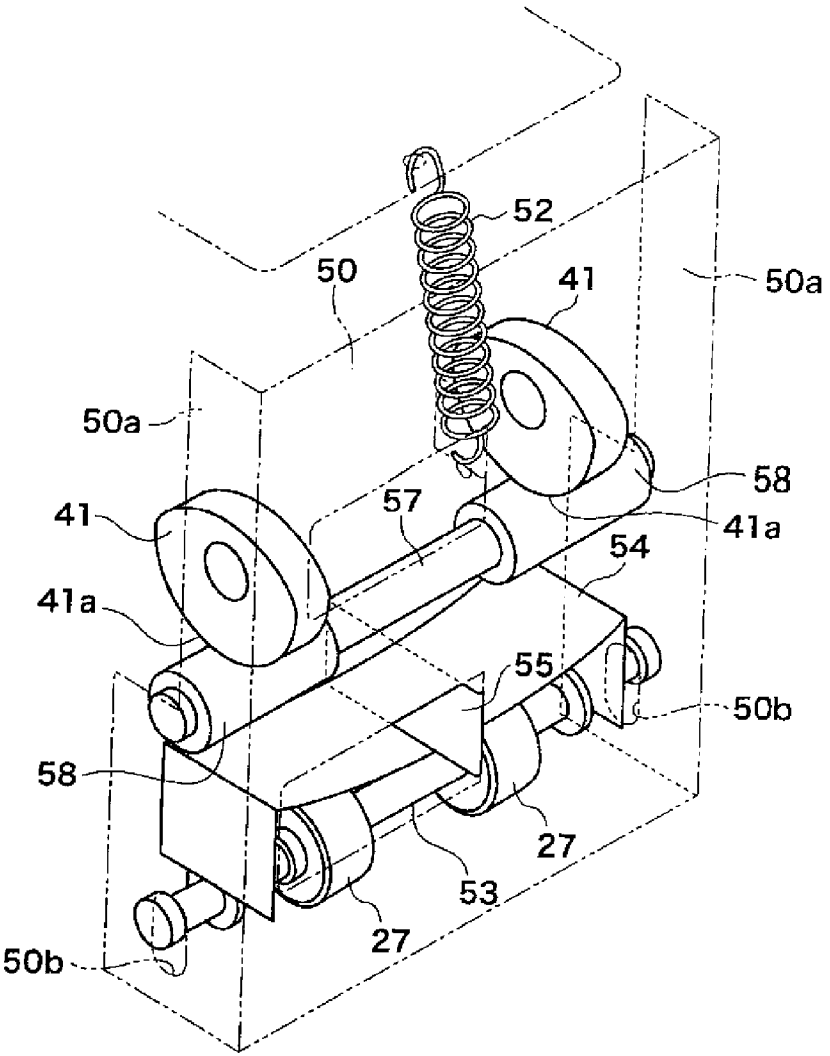
FIG. 12(A) shows the upper roller positioned at the upper position and FIG. 12(B) shows the upper roller positioned at the lower position.
Figure 12A:
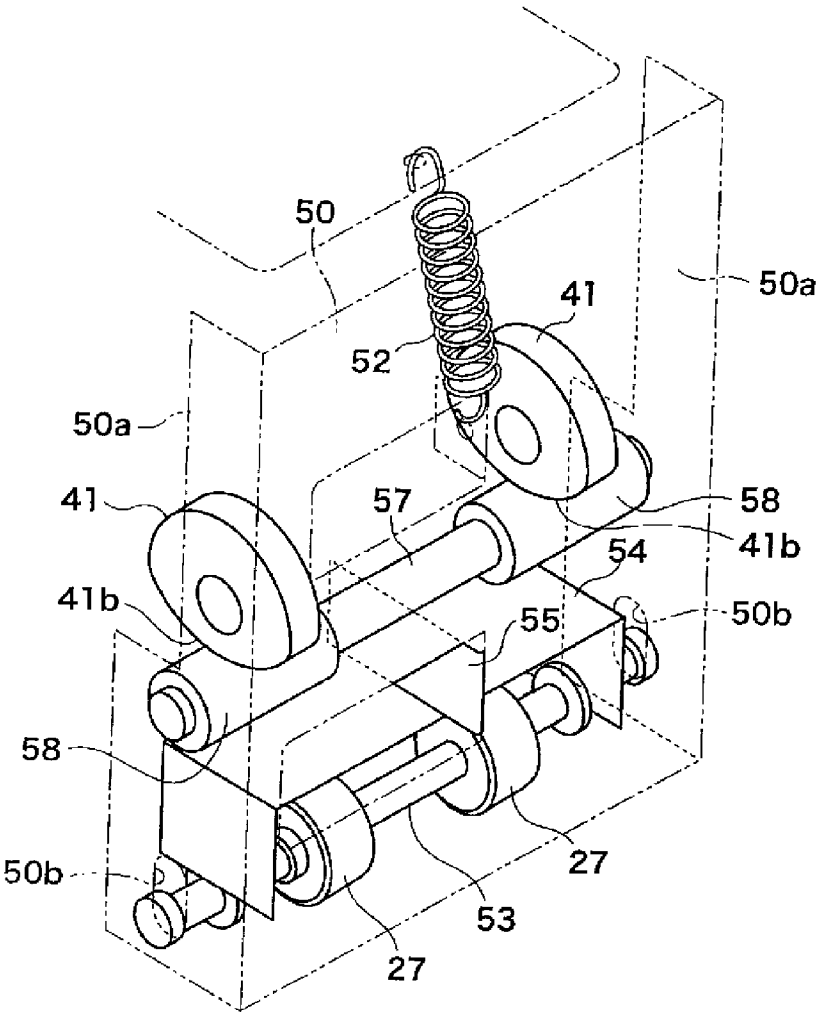

1 sheet attaching apparatus
2 main casing
3 movable casing
4 slider
5 linear guide
10 substrate supply station
11 stock section
13 feed roller
20 attaching station
21 substrate supply unit
22 upper and lower rollers
23 guide sheet
24 stopper
25 pin
26 spring
27 upper roller (press roller)
28 lower roller (feed roller)
30 rotating shaft
31 gear
32 motor
33 reduction gear
35 roller

36 connecting rod
37 pin
38 pin
41 cam
50 movable plate
51 pin
52 spring
53 rotating axis
54 plate spring
55 projection
58 cam follower
60 carrier strip feed station
61 roll
62 reel
63 take-up reel
65 guide plate
66 return roller
68 guide roller
70 tension roller
80 fixing station
81 feed rollers
82 heat rollers
83 heat plate

What is claimed is:

1. An apparatus for placing one of a plurality of adhesive sheets of predetermined size, arranged on a carrier strip in rows, onto a substrate precisely and attaching them together comprising:

a substrate feed station for feeding said substrate to an attaching position along a feed path;

a carrier strip feed station for feeding said carrier strip;

a peeling station for peeling said adhesive sheet off from said carrier strip;

a non-adhesive guide sheet for leading said peeled adhesive sheet to the attaching position while keeping away from said substrate;

a stopper to which forward edges of said substrate and said adhesive sheet contact at the attaching position, movable between a position across the feed path and a position off the feed path;

a movable press roller for pressing the forward portion of said adhesive sheet onto the forward portion of said substrate to attach said adhesive sheet onto said substrate at the attaching position; and a feed roller arranged facing said press roller and for discharging the adhered sheet and substrate from the attaching position, wherein said guide sheet has slits extending in the feed direction at the forward portion and said press roller presses the forward portion of said sheet to the forward portion of said substrate through said slits so as to attach said sheet onto said substrate.

2. A sheet attaching apparatus according to claim 1, wherein said stopper is retracted from the feed path after the adhesion of said sheet and said substrate, said feed roller is driven to discharge the adhered sheet and substrate through between said press roller and said feed roller, and after the adhered sheet and substrate are discharged from the attaching position completely, said press roller is retracted and also said stopper is advanced across the feed path.

3. A sheet attaching apparatus according to claim 1 further comprising:

a crank arm and a cam provided on a rotating shaft; a connecting rod, coupled to said crank arm at one end and coupled to said stopper at the other end, for oscillating said stopper between a position off the feed path and a position across the feed path;

a movable plate movable upward and downward relative to a main casing and pressed down by a function of said cam, said press roller being mounted to said movable plate movably upward and downward;

a spring mounted to the axis of said press roller; and a projection protruding from said movable plate and pushing said spring downward.

4. A sheet attaching apparatus according to claim 1 further comprising:

a substrate supply station for storing said substrates and feeding one of said substrates to said substrate feeding station;

wherein two or more stations among said substrate supply station, said carrier strip feeding station and said peeling station are stored in the main casing, two or more components among of said substrate feed station, said guide sheet, said stopper, said press roller and said feed roller are stored in one movable casing and said movable casing is movable relative to said main casing in the direction perpendicular to the feed direction.

* * * * *